US005332419A

United States Patent [19]

Lemay et al.

[11] Patent Number: 5,332,419

[45] Date of Patent: Jul. 26, 1994

[54] PNEUMATIC INJECTION OF POWDER OR GRANULE THROUGH SUBMERGED TUYERES

[75] Inventors: Raymond Lemay; Robert A. Vos, both of Rouyn-Noranda, Canada

[73] Assignee: Noranda Inc., Toronto, Canada

[21] Appl. No.: 76,851

[22] Filed: Jun. 15, 1993

[30] Foreign Application Priority Data

Jul. 13, 1992 [CA] Canada ..... 2073707

[51] Int. Cl.[5] ..... C21B 7/16

[52] U.S. Cl. ..... 75/533; 266/267

[58] Field of Search ..... 266/267; 75/533

[56] References Cited

U.S. PATENT DOCUMENTS 4,700,930 10/1987 de Pressigny ..... 266/267

4,711,433 12/1987 Goto et al. ..... 266/222

4,771,993 9/1988 Zanetta ..... 266/267

*Primary Examiner*—Peter D. Rosenberg

*Attorney, Agent, or Firm*—Fitzpatrick, Cella, Harper & Scinto

[57] ABSTRACT

A method of injecting powdered material into converters or other metallurgical vessels equipped with at least one submerged tuyere and a gas flow line interconnecting the tuyere to a bustle pipe or other source for blowing converting gas into the tuyere comprises providing an injection pipe fitted into the tuyere at an acute angle, preferably about 20° C., with respect to the centre line of the tuyere and intersecting the tuyere at a point downstream of the gas line flow line entrance, and introducing fluidized powdered material into the tuyere through such injection pipe.

6 Claims, 1 Drawing Sheet

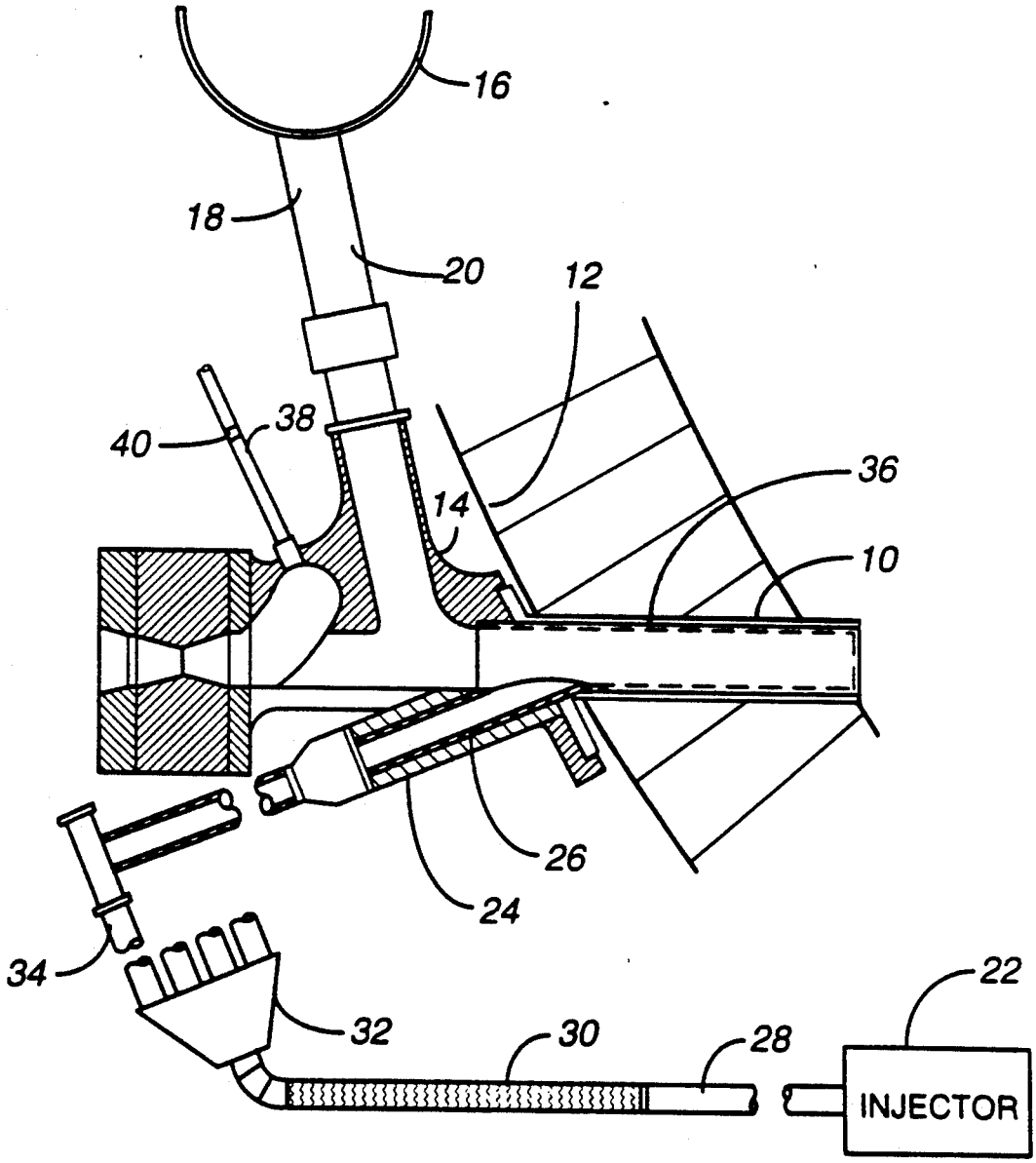
16
18
20
12
40
38
36
14
10
26
24
34
22
32
30
28
INJECTOR

PNEUMATIC INJECTION OF POWDER OR GRANULE THROUGH SUBMERGED TUYERES

This invention relates to a method and a system for injecting pneumatically conveyed powder or granule (hereinafter referred to as powdered material) through the submerged tuyeres of converters or other metallurgical vessels.

Injection of powdered material through the tuyeres of converters and other metallurgical vessels is well known in the prior art. In U.S. Pat. No. 4,711,433 issued Dec. 8, 1987, a system is disclosed whereby materials are injected through a lance introduced within the tuyere pipe. The disclosed system has several drawbacks. The injection pipe must be removed when mechanical punchers are used, to let the machine pass to punch the tuyere line even if the injection tuyere does not need punching, or for tuyere inspection. Injection capacity is restricted to the size of the pipe that can be introduced in the tuyere without interrupting the normal tuyere gas flow. This could cause a tuyere blockage and metal flow-back if the injection line gas flow is reduced or interrupted. The system results in higher injection pressure.

In Canadian patent application no. 576,976 filed Sep. 9, 1988, a system is disclosed whereby materials are injected through a so-called "downcomer" pipe interconnecting the tuyere to the so-called "bustle" pipe. A flapper valve located in the downcomer pipe is used to prevent materials back-flow into the bustle pipe and high pressure air is used to purge accumulated powder in the tuyere body prior to punching.

The system disclosed in the above patent application has the following drawbacks when applied to a high flow rate injection system:

a) The flapper valve does not stay continuously closed during injection, but rattles during transitional periods when the injection pressure is not sufficiently high to overcome the bustle pipe pressure plus the weight of the flapper. This rattling allows powdered material to migrate into the bustle pipe;

b) The geometry of the disclosed design allows powdered materials to migrate into the tuyere's all cavity and eventually discharge to the atmosphere when the tuyere is punched.

The object of the present invention is to provide a new method and system for injecting powdered material through the tuyeres of converters or similar metallurgical vessels at high flow rate without the above mentioned drawbacks.

In the present invention, powdered material is introduced into the tuyere through an injection pipe fitted into the tuyere at an acute angle, preferably around 20°, with respect to the centre line of the tuyere and intersecting the tuyere at a point downstream of the bustle pipe air entrance, so that the powdered material is kept as far as possible away from the bustle pipe air entrance.

High pressure purge air is introduced into the tuyere ball cavity to maintain a constant out flow of air from this area to the interior of the converter, thus preventing powdered materials from migrating backward into the ball cavity and subsequently discharging into the atmosphere when the tuyere is punched.

The system for injecting powdered material comprises an injection pipe fitted into the tuyere at an acute angle, preferably around 20°, with respect to the centre line of the tuyere and intersecting the centre line of the tuyere at a point downstream of the bustle pipe air entrance, a pipeline connected to the injection pipe, and a pneumatic conveying equipment for supplying fluidized powdered material to such pipeline.

To prevent material back-flow into the bustle pipe, a spring loaded check valve with a tight closure at 1 psi differential pressure is used; this pressure has been found to be adequate to prevent material back-flow during transitional periods.

A high pressure purge air line is connected to the ball valve cavity of the tuyere body to prevent any accumulation of powdered material and subsequent discharge to the atmosphere when the tuyere is punched or during inspection of the tuyere.

The invention will now be disclosed, by way of example, with reference to the accompanying drawing in which:

FIG. 1 is a side view of the injection system in accordance with the present invention.

Referring to FIG. 1, there is shown a conventional tuyere pipe 10 inserted through the wall of a converter 12. Tuyere pipe 10 is connected to a tuyere body 14. Low pressure air (12–20 psi) is supplied from a bustle pipe 16 to the tuyere body 14 through a so-called downcomer line 18 and a spring loaded check valve 20. In accordance with the present invention powdered material such as sweeps, coal dusts, or dry concentrates, is fluidized in a suitable injector 22 or other pneumatic conveying equipment and fed into an injection pipe 24 which is lined with a wear sleeve 26. Injection pipe 24 is angled at about 20° with the centre line of the tuyere and intersects the tuyere at a point downstream of the downcomer line entrance into the tuyere body, so that the powdered material is kept as far as possible away from the downcomer line. The injector is connected to the injection pipe through a pipeline 28, a flexible hose 30 or other suitable attachment to allow free movement of the converter, a splitter 32 and a branch line 34. The injection air flow and pressure depend on the type of injector used, conveying line diameter and length, air flow, material/air ratio, material density, as well as the tuyere diameter. Typical pressures are about 150 psi at the injector and about 20 psi at the injection pipe. In operation, the higher injection air pressure and the powdered material flowing into the injection pipe 24 force the spring loaded check valve 20 to close the opening for the air flow from the bustle pipe. This reduces the tuyere air flow and velocities and hence tuyere wear. It also prevents any back flow of powdered material into the bustle pipe in case of tuyere blockages. When injection flow is cut-off, the check valve 20 will open immediately to allow bustle pipe air to enter into the tuyere and prevent back flow of molten material into the tuyere.

A wear sleeve 36 is provided around tuyere pipe 10 to protect the tuyere pipe from direct exposure to the conveyed solid.

A high pressure air line 38 (about 70–100 psi) is connected to the tuyere body 14 in the area of the conventional ball valve cavity of the tuyere body to provide purge air to the cavity and so prevent any accumulated powder when the tuyere needs punching or inspection. A check valve 40 is provided in pressure line 38 to prevent accidental back flow of molten metal if the purge air line is accidently disconnected.

Use of the system in accordance with the present invention has shown that the tuyere injection of powdered material through an injection pipe below the tuyere body is an efficient method for continuous or semi-continuous injection of powdered material, with minimum wear of the tuyere, and without the labour needed for insertion and removal of a lance into the tuyere. The system provides for free movement of the converter and operation of the tuyere puncher without restriction.

Although the invention has been disclosed with reference to a preferred embodiment, it is to be understood that it is not limited to the use of such embodiment and that other alternatives are also envisaged within the scope of the following claims.

We claim:

1. A method of injecting powdered material into converters or other metallurgical vessels equipped with at least one submerged tuyere and a gas flow line interconnecting said tuyere to a bustle pipe or other source for blowing converting gas into the tuyere, the gas flow line comprising a check valve to prevent back flow of the powdered material into the bustle pipe in case of tuyere blockage, said method comprising the steps of:

a) providing an injection pipe fitted into the tuyere at an acute angle with respect to the centre line of the tuyere and intersecting the tuyere at a point downstream of such gas flow line entrance; and b) introducing fluidized powdered material into said tuyere through said injection pipe.

2. A method as defined in claim 1, further comprising introducing a high pressure purge air into the ball cavity area of the tuyere body to prevent any accumulation of powdered material and subsequent discharge of such material into the atmosphere when the tuyere needs punching or inspection.

3. A method as defined in claim 2, wherein said high pressure purge air is provided by a 70–100 psi air pressure source.

4. A system for injecting powdered material into converters or other metallurgical vessels equipped with at least one submerged tuyere and a gas flow line interconnecting said tuyere to a bustle pipe or other source for blowing converting gas into the tuyere, said system comprising:

a) an injection pipe at an acute angle with respect to the centre line of the tuyere and intersecting the tuyere at a point downstream of said gas flow line entrance;

b) a pipeline connected to the injection pipe;

c) a pneumatic conveying equipment for supplying fluidized powdered material to said pipeline; and d) a check valve located in the gas flow line from the bustle pipe to prevent back flow of the powdered material into the bustle pipe in case of tuyere blockage.

5. A system as defined in claim 4, wherein said pipeline includes a flexible hose or other suitable attachment to allow free movement of the vessel without any restriction.

6. A system according to claim 4, wherein the check valve comprises a spring loaded check valve.

* * * * *